United States Patent [19]

March et al.

[11] 4,270,874

[45] Jun. 2, 1981

[54] BOTTOM TENSION FENCE-TYPE WATER BUOYANT CONTAINMENT BOOM

[75] Inventors: Frank A. March, Reston; Louis S. Brown, Jr., Stevens City, both of Va.

[73] Assignee: Seaward International, Inc., Falls Church, Va.

[21] Appl. No.: 957,562

[22] Filed: Nov. 3, 1978

[51] Int. Cl.[3] ..... E02B 15/04

[52] U.S. Cl. ..... 405/63; 405/72

[58] Field of Search ..... 405/63–72; 210/DIG. 25, DIG. 26; 229/52 R, 52 B

[56] References Cited

U.S. PATENT DOCUMENTS

| | | | |
|---|---|---|---|
| 3,392,876 | 7/1968 | Allred | 229/52 B X |
| 3,539,013 | 11/1970 | Smith | 405/66 X |
| 3,708,982 | 1/1973 | Blockwick | 114/267 X |
| 3,766,738 | 10/1973 | Gauch | 405/65 |
| 3,818,708 | 6/1974 | Benson | 405/65 |
| 3,839,869 | 10/1974 | Green | 405/70 |
| 3,848,417 | 11/1974 | Smith et al. | 405/70 |
| 3,852,965 | 12/1974 | Rudd | 405/70 |
| 3,903,701 | 9/1975 | Gauch | 405/66 |
| 3,971,220 | 7/1976 | Kinase et al. | 405/66 |
| 4,030,304 | 6/1977 | West | 405/70 |
| 4,062,191 | 12/1977 | Preus | 405/70 |
| 4,073,143 | 2/1978 | Preus | 405/70 |
| 4,078,513 | 3/1978 | Dorsch | 405/63 X |
| 4,116,007 | 9/1978 | Stagemeyer et al. | 405/70 |

OTHER PUBLICATIONS

Modern Textile Machines, Mar. 1976, pp. 17 & 18.

*Primary Examiner*—Dennis L. Taylor

*Attorney, Agent, or Firm*—Finnegan, Henderson, Farabow, Garrett & Dunner

[57] ABSTRACT

A flexible, fence-type, water-borne pollutant containment boom is disclosed having a flexible, permanently attached tension reinforcing belt of continuous, substantially parallel, high modulus, aramid fibers adhesively secured to the boom proximate its bottom edge and having a plurality of handles spaced along the top edge of the boom, the handles being molded on both sides of the boom and overlapping the top edge and surrounding openings cut in the boom proximate the top edge leaving flaps of boom material to selectively close the openings.

20 Claims, 5 Drawing Figures

BOTTOM TENSION FENCE-TYPE WATER BUOYANT CONTAINMENT BOOM

BACKGROUND OF THE INVENTION

1. Field of the Invention

The present invention relates generally to barriers for containing and controlling water-borne pollutants. More particularly, the invention relates to a water-borne pollutant containment boom of the type which is deployable from and retrievable on a reel.

2. Description of the Prior Art

As a result of the recent concern over pollution of the oceans, lakes and rivers with surface pollutants, particularly oil, there has been widespread development of floating containment booms for controlling the spread of pollutants, such as oil, on the surface of bodies of water and for assisting in removal of the pollutants from the water.

Generally floating booms designed to confine oil or other floating pollutants include an elongated panel adapted to be drawn around the area in which the oil or pollutant is to be confined which is buoyantly supported by floats or their equivalent. Preferably, these floating booms should be capable of being easily deployed and retrieved and compactly stored aboard vessels or aircraft.

Containment booms of the prior art have been of various designs, the common features of which include a wall-like barrier vertically supported in the water with a portion of the barrier extending above the surface of the water and a portion below the surface. Some of the prior art barriers have been relatively rigid and hinged in sections to permit folding in an accordion-like fashion for retrieval and storage while others have been of a flexible, continuous construction retrievable on reels. Because of the frequent deployment and retrieval and the movement from shore storage to shipboard or aircraft, booms are subjected to significant abrasion reducing the useful life of the boom.

Most booms are intended to be towed to some extent through the water in order to gather the pollutant in a confined area. This movement through the water imposes a longitudinal tension on the bottom edge of the boom under the surface of the water. With flexible booms, this water-imposed tension will distort or rupture the bottom edge of the boom absent a means for reinforcing the bottom edge. Tension-reinforcing means have included rigid clamp-like devices placed on the bottom edge of the boom or chains or metal cables attached along the length of the bottom edge. These prior art bottom edge-reinforcing devices have served the purpose of preventing rupture of the bottom edge of the boom and have contributed to the overall stability of the boom but have created difficulties with recovery and storage of the boom. The rigid structures, chains or metal cables preclude recovery of the boom on a reel as they abrade the surface of the boom on recovery. Removal of the structures, chains, etc., during recovery and reinstallation or deployment adds a significant, time-consuming step to the operation. Furthermore, the prior art reinforcing means have been bulky, snag or catch on protrusions aboard ship or aircraft, are difficult to clean after use with an oil spill or other pollutant, and are subject to corrosion.

Another difficulty in the prior art booms is the incorporation of the means for handling the booms in deployment, recovery and when it is desired to move the boom manually in the water for positioning or attachment to towing devices or other booms. Some prior art booms have included handles attached to the top of the boom to facilitate handling. These handles extend above the top of the boom adding additional dimension to the boom and creating additional problems in recovery and deployment of the boom, i.e., the handles catch or snag on protrusions in ships or aircraft and abrade the surface of the flexible boom that is retrieved on a reel.

The instant invention provides a flexible, water-buoyant boom designed to overcome the disadvantages of prior art booms. The boom of the invention incorporates a flexible tension member on the bottom edge of the boom which permits deployment from and retrieval on a reel without the disadvantages of the prior art tension members. Furthermore, the instant invention provides handles that are recessed into the top edge of the boom to provide a means for manually deploying, retrieving or moving the boom but overcomes the disadvantages of the prior art handles. In addition to removing the principal causes of abrasion, the boom of the instant invention is covered with a tough, oil- and abrasion-resistant coating that prolongs the useful life of the boom.

SUMMARY OF THE INVENTION

The invention, as broadly described and claimed herein, is a fence-type containment boom for gathering and containing water-borne pollutants on the surface of a body of water which boom comprises a continuous, elongated, flexible panel having top and bottom edges and two ends; a plurality of floats secured by adhesive to both sides of the panel, the floats being uniformly spaced along a line substantially parallel to the longitudinal axis of the panel and adapted to support the panel buoyantly upon the surface of water with part of the panel extending above the water's surface; means adhesively secured to one side of the panel proximate the bottom edge of reinforcing the bottom edge of the panel, the reinforcing means being flexible, longitudinally continuous and coextensive in length with the panel and permitting application of longitudinal stresses to the bottom edge; a plurality of elongated stiffening battens adhesively secured to one side of the panel normal to its longitudinal axis, the battens being uniformly spaced and extending substantially from the top to the bottom edges of the panel; an oil-resistant, polyurethane elastomer coating uniformly covering both sides of the panel, the floats, the battens and the reinforcing means; a plurality of ballast weights attached to the panel proximate the bottom edge and uniformly spaced on a line substantially parallel to the longitudinal axis of the panel; and means at the end of the panel for attachment to means for towing the panel through the water to gather the oil on the surface for removal.

Preferably, the invention also includes a plurality of handles secured to and overlapping the top edge of the panel and surrounding openings in the panel proximate its top edge, each opening having a closure flap formed by a rectangular piece of the panel cut on three sides to form the opening and hinged to the panel proximate its top edge, the handles being uniformly spaced along the top edge of the panel.

Preferably, the reinforcing means is a belt of continuous, elongated, closely spaced, substantially parallel, high modulus, aramid fibers adhesively secured to one side of the panel proximate the bottom edge and substantially parallel to the longitudinal axis of the panel.

DESCRIPTION OF THE PREFERRED EMBODIMENT

A fence-type containment boom containing and gathering water-borne pollutants on the surface of a body of water comprises a continuous, elongated, flexible panel having top and bottom edges and two ends. As here embodied, and seen in FIG. 1, the boom includes a continuous, elongated, flexible panel 10 having top 12 and bottom 14 edges and two ends 16 (only one of which is depicted).

Preferably, panel 10 is a continuous, seamless, elongated panel of heat set polyester duck with a 4-ply of 1000 denier warp and a 2-ply of 1300 denier warp. The duck fabric is preferably arranged so that the warp fibers are continuous between the ends 16 of the panel 10.

The boom includes a plurality of floats secured by adhesive to both sides of the panel, the floats being uniformly spaced on a line substantially parallel to the longitudinal axis of the panel and adapted to support the panel buoyantly on the surface of water with part of the panel extending above the water's surface.

Figure 1:
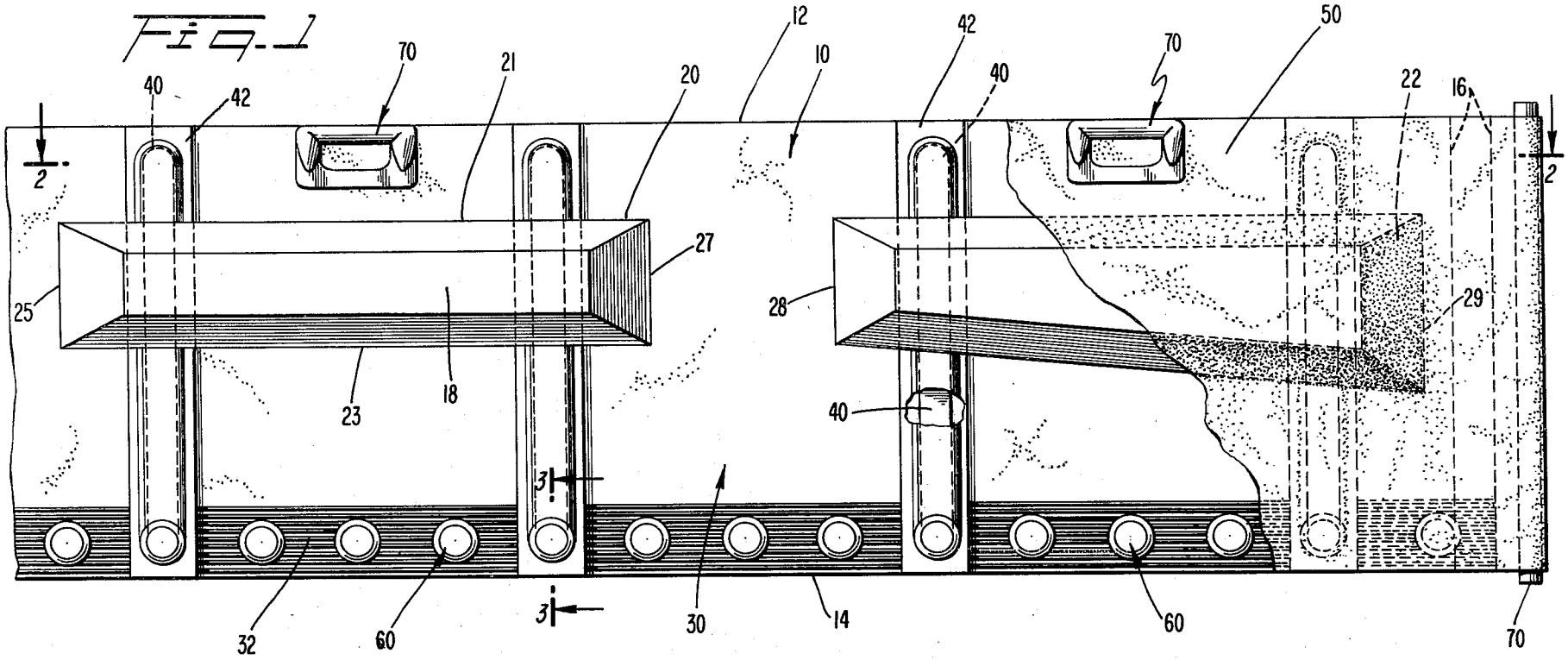
FIG. 1 is a side view of the boom of the invention including one end.
Figure 2:
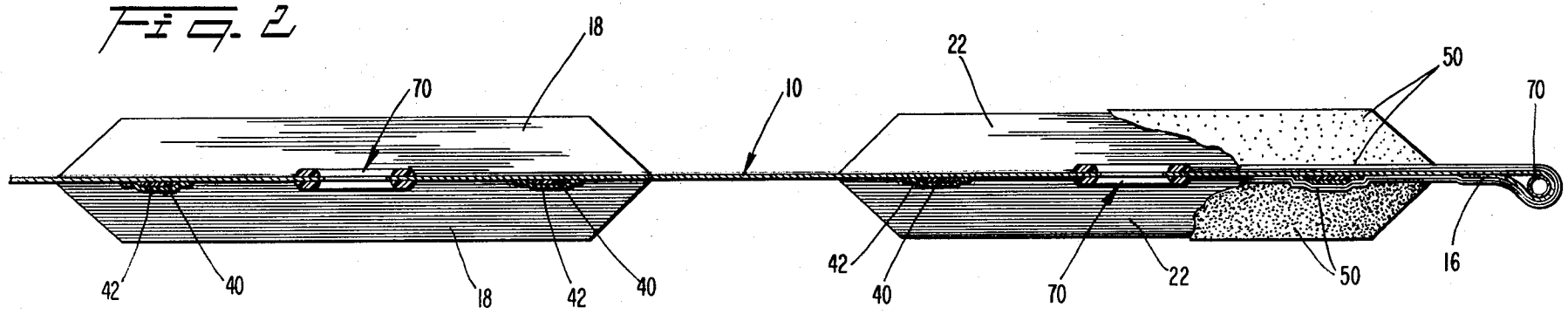
FIG. 2 is a top sectional view of the boom in FIG. 1 taken along line 2—2.

As seen in FIGS. 1 and 2, the floats 18 are adhesively secured to both sides of the panel 10 and are so arranged on each side that each float 18 is opposite another float 18 on the opposite side of the panel 10.

The floats 18 may be formed of closed-cell, cross-linked ethylene-vinyl acetate foam and either molded in one piece or constructed of laminated layers of foam. Preferably, the floats 18 have a substantially right rectangular truncated pyramid shape which is secured at its base 20 to the panel 10. The floats 18 may be secured to the panel 10 by any appropriate adhesive such as a contact adhesive identified by the 3-M Company as No. 4693.

It is preferred that the floats 18 be spaced on a line substantially parallel to the longitudinal axis of panel 10 and that that line be so located below the top edge 12 that approximately 40% of the distance from the top 12 to the bottom 14 of the panel is above the water's surface when the boom is in the water. Stated another way, the line on which the floats 18 are centrally located and uniformly spaced is located below the top edge 12 of the panel 10 approximately one third of the distance from the top 12 to bottom 14. That portion of the panel extending above the water's surface, commonly referred to as the freeboard, is used to prevent splashing of the pollutants over the top of the boom due to rough water, waves or swells.

Each float 18 has a base 20 having two equal opposed long sides 21 and 23 and two equal opposed short sides 25 and 27. It is preferred, however, that the floats 22 proximate the ends 16 provide a greater buoyancy for supporting the ends 16. Accordingly, the floats 22 proximate each end 16 of the panel 10 have one of the short sides 29 of the base 20 longer than the other short side 28, the longer short side 29 being closest to the respective end 16 of the panel 10. This greater dimension increases the size of the floats 22 providing the necessary extra buoyancy.

In accordance with the invention, the boom includes means adhesively secured to one side of the panel proximate the bottom edge for reinforcing the bottom edge, the reinforcing means being flexible, longitudinally continuous and coextensive in length with the panel and permitting application of longitudinal stresses to the bottom edge.

Figure 3:
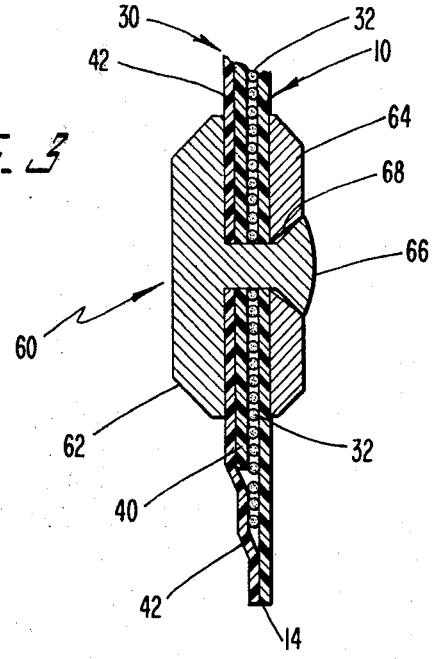
FIG. 3 is a partial side sectional view of the boom in FIG. 1 taken along line 3—3.
Figure 4:
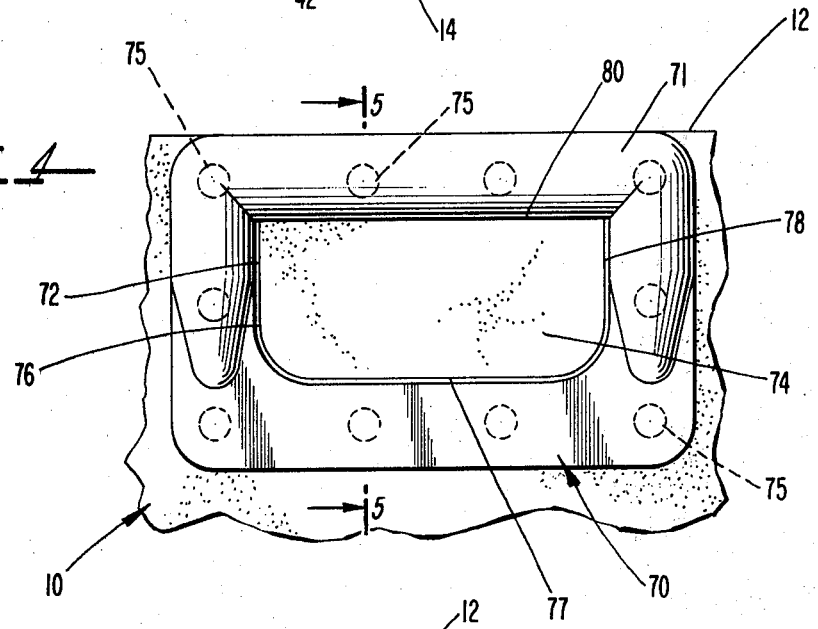
FIG. 4 is an enlarged side view of the handle construction of the boom depicted in FIG. 1.
Figure 5:
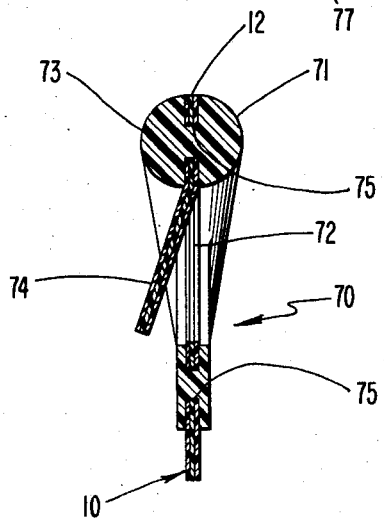
FIG. 5 is a side sectional view of the handle depicted in FIG. 4 taken along line 5—5.

As here embodied and seen in FIGS. 1 and 3, the reinforcing means is a belt, generally 30, of continuous, elongated, closely spaced, substantially parallel, high modulus, aramid fibers 32 adhesively secured to one side of the panel 10 proximate the bottom edge 14 and substantially parallel to the longitudinal axis of the panel 10. Any aramid fiber having a high modulus so that it may withstand high tension without distortion or stretching may be used as the reinforcing means. One such fiber is 15000 denier yarns of DuPont fiber identified by the trademark KEVLAR 29.

Preferably, the fibers are secured to the panel by a heat-cured urethane matrix, the urethane matrix being continuous and keeping separate and substantially parallel to the individual fibers of the belt 30. Any heat sensitive polyether-based urethane adhesive may be used to secure fibers 32 to the panel 10 and to form the matrix separating and holding in parallel relationship the fibers 32. One such heat-sensitive urethane adhesive is Dupont ADIPRENE L-42 elastomer with Dupont CAYTUR-21 curative.

A plurality of elongated stiffening battens are adhesively secured to one side of the panel normal to the panel's longitudinal axis, the battens being uniformly spaced and extending substantially from the top to the bottom edges of the panel.

As depicted in FIGS. 1, 2 and 3, battens 40 are adhesively secured to one side of the panel 10 in substantially spaced parallel relationship normal to the longitudinal axis of panel 10. Preferably, battens 40 are steel, such as blue-temperated and polished high carbon spring steel, AISI 1095. It is also preferred that each batten be covered by a batten cover 42. The batten cover 42 is preferably a piece of fabric adhesively secured to the panel 10 around the periphery of battens 40. The batten fabric may be a woven nylon webbing or tape secured by heat-sensitive urethane adhesive. The battens 40 should extend from proximate the top edge 12 to proximate the bottom edge 14 to provide a vertical stiffness to the panel 10.

An oil resistant, polyurethane elastomer coating uniformly covers both sides of the panel, the floats, the battens, and the reinforcing means.

As shown in FIG. 2, the polyurethane elastomer coating 50 covers both sides of the panel 10, the battens 40 and batten covers 42, the floats 18 and 22, and the reinforcing belt 30. The coating 50 may be any solventless polyether-based urethane equivalent to Uniroyal VIBRASPRAY 80 or Essex BETATHANE/E 23-707/23-108. The coating provides a tough, oil-resistant cover which is easily cleaned due to its smooth, seamless exterior.

A plurality of ballast weights are attached to the panel proximate the bottom edge and uniformly spaced on a line substantially parallel to the longitudinal axis of the panel. As seen in FIGS. 1 and 3, the ballast weights 60 may be a type of rivet having a male portion 62 and a female portion 64. The stem 66 of the male portion 62 is punched through the panel 10 and reinforcing belt 30 proximate the bottom edge 14 of the panel 10 or, as depicted in FIG. 3, is punched through the sandwich layer of the panel 10, reinforcing belt 30, batten 40 and batten cover 42. The stem 66 passes through an opening 68 in the female portion 64 and is crimped or spread much like a rivet to secure the two portions 62 and 64 of the ballast weight 60 together and on opposite sides of the boom. Preferably the ballast weights are made of metal which may be lead, calcium-lead alloy or any other metal having sufficient weight and resistance to corrosion.

Means are also provided at the ends of the panel for attachment to a means for towing the panel through the water to gather the oil on the surface for removal.

Although any means may be used for attaching the end 16 of the panel 10 to a means for moving it through the water, as here embodied and depicted in FIGS. 1 and 2, the attachment means is a rod 70 which is secured to the end 16 of panel 10 by tightly wrapping the end 16 of the panel 10 around the rod 70 and adhesively securing the end 16 to the panel 10. Any number of known means of securing the panel 10 to the means for towing it through the water may be used and the use of the rod 70 is only one possible method. The rod may preferably be nylon to avoid corrosion problems and to reduce the weight of the boom.

In accordance with the invention, a plurality of handles are secured to, and overlap the top edge of, the panel and surround openings in the panel proximate the top edge.

As here embodied, the boom includes a plurality of handles 70 as seen in FIGS. 1, 2, 4 and 5. The handles 70 are uniformly spaced along, secured to, and overlap the top edge 12 of the panel 10 and surround openings 72 in the panel 10 proximate the top edge 12. Preferably, each opening 72 in panel 10 has a closure flap 74 formed by a rectangular piece of the panel 10 cut on three sides 76, 77, 78 and remaining attached to the panel 10 proximate its top edge 12 on the fourth side 80.

It is also preferred that the handles 70 be molded in place with the top edge of the handle 70 being even with the top edge 12 of the panel 10. To facilitate interconnection of the two halves 71 and 73 of the handle 70, holes 75 are punched through the panel 10 before molding the handles 70 in place. The handles may be molded of a polyether-based urethane such as Essex BETATHANE/E 23-705/23-104.

In operation, the boom is stored on a reel or in a box until needed. When the occasion arises with an oil spill or other pollutant spill, the boom is unreeled or removed from the box and deployed in the water to surround the spill. Depolyment is facilitated by the handles 70 and the integral, flexible reinforcing means 30 which permits the reeling of the boom and precludes the additional step of attaching an external reinforcing means on deployment of the boom. The floats 18 and 22 and the battens 40 will maintain the boom in a vertical orientation in the water with approximately 40% of the boom being freeboard to preclude splash of pollutant over the boom and the flaps 74 will substantially limit splash of pollutant through the handle openings. The weights 60 provide ballast sufficient to prevent the movement of the water from tipping the boom or raising it out of the water. The tension-reinforcing belt 30 resists deformation of the bottom edge of the boom due to the pressure of the water as the boom is towed through the water and keeps the bottom edge of the boom in tension while in the water.

In accordance with the invention, a method for assembling a fence-type containment boom for containing water-borne pollutants comprises laying out a continuous, seamless panel 10 having top 12 and bottom 14 edges and two opposed ends 16 with the warp of the fibers being continuous between the ends 16; coating both sides of a plurality of stiffening battens 40 with a heat-sensitive adhesive and placing them in a uniform arrangement normal to and spaced along the longitudinal axis on one side of the panel 10; applying additional adhesive to one side of the panel 10 around the perimeter of each batten 40 and placing a fabric batten cover 42 over each batten 40 and heat-curing the adhesive for securing the battens 40 and batten covers 42 to the panel 10.

The method of the instant invention further includes adhesively securing a plurality of floats 18 and 22 to each side of the panel 10, the floats being uniformly spaced on a line substantially parallel to the longitudinal axis of the panel 10; and immersing a plurality of continuous, elongated, high-modulus aramid fibers 32 in a heat-sensitive adhesive, arranging the adhesive-coated fibers 32 in a closely spaced substantially parallel relationship on one side of the panel 10 proximate the bottom edge 14 substantially parallel to the longitudinal axis of the panel 10, placing the fibers in tension, and applying uniform heat simultaneously to the entire length of the fibers 32 and adhesive to cure the adhesive and secure the fibers 32 to the panel 10. The next steps include covering both sides of the panel 10, the floats 18 and 22, the battens 40, batten covers 42, and tension fiber belt 30 with a smooth, continuous coating of polyether urethane by an airless, solventless spray; and attaching a plurality of ballast weight rivets uniformly spaced along a line proximate the bottom edge substantially parallel to the longitudinal axis of the panel, the male and female parts of the rivets being on opposite sides of the panel.

The method of the instant invention also includes the step of marking a plurality of rectangles for openings spaced on a line proximate the top edge and substantially parallel to the longitudinal axis of the panel 10, placing holes 75 through the panel 10 proximate the perimeter of the marked rectangles for passage of elastomer, molding an elastomer handle around each marked rectangle on both sides of the panel 10 and over the top edge 12 thereof, and cutting three sides 76, 77, 78 of the marked rectangle to provide a flap 74 hinged at the top proximate the top edge 12 for closing the resulting opening 72 surrounded by the handle 70.

It will be apparent to those skilled in the art that various modifications and variations can be made in the boom of the present invention and in the construction of the boom without departing from the scope and spirit of the invention. Thus, it is intended that the present invention cover the modifications and variations of the invention provided they come within the scope of the appended claims and their equivalents.

What is claimed is:

1. A fence-type containment boom for containing and gathering water-borne pollutants on the surface of a body of water, comprising:

(a) a continuous, elongated, flexible panel having top and bottom edges and two ends;

(b) a plurality of floats secured by adhesive to both sides of said panel, said floats being centrally located and uniformly spaced on a line substantially parallel to the longitudinal axis of said panel and adapted to support said panel buoyantly upon the surface of water with part of said panel extending above the water surface;

(c) a bottom-edge reinforcing belt of flexible, continuous, elongated, closely spaced, substantially high modulus, aramid fibers adhesively secured to one side of said panel proximate the bottom edge for reinforcing the bottom edge of said panel, said reinforcing belt being longitudinally continuous and coextensive in length with said panel and permitting application of longitudinal stresses to said bottom (d) a plurality of elongated stiffening battens adhesively secured to one side of said panel normal to its longitudinal axis, said battens being uniformly spaced and extending substantially from the top to the bottom edges of said panel;

(e) an oil resistant, polyurethane elastomer coating uniformly covering both sides of said panel, said floats, said battens and said reinforcing means;

(f) a plurality of ballast weights attached to said panel proximate said bottom edge and uniformly spaced on a line substantially parallel to the longitudinal axis of said panel; and (g) means at the ends of said panel for attachment to a means for towing said panel through the water to gather the oil on the surface for removal.

2. The boom of claim 1 also including a plurality of handles secured to overlapping, and substantially coterminous with the top edge of said panel and surrounding openings in said panel proximate its top edge, each said opening having a closure flap formed by a rectangular piece of said panel cut on three sides to form said opening and remaining attached to said panel proximate its top edge, said handles being uniformly spaced along the top edge of said panel.

3. The boom of either of claims 1 or 2 wherein said battens are steel and also including batten covers secured by adhesive to said panel over said battens for additional securing of said battens to said panel.

4. The boom of either of claims 1 or 2 wherein said panel is a continuous, seamless, elongated panel of heat set polyester duck with a 4 ply of 1000 denier warp and a 2 ply of 1300 denier warp.

5. The boom of either of claims 1 or 2 wherein each said float has a substantially right rectangular truncated pyramid shape adhesively secured at its base to said panel.

6. The boom of claim 5 wherein the base of each said float has two opposed long sides and two opposed short sides and wherein the floats proximate each end of said panel have one of the short sides longer than the other short side, said longer short side being proximate the respective end of said panel.

7. The boom of either of claims 1 or 2 wherein said floats are formed of closed-cell cross-linked ethylene-vinyl acetate foam.

8. The boom of claim 7 wherein said floats are formed of laminated layers of foam.

9. The boom of claim 7 wherein said floats are molded in one piece.

10. The boom of either of claims 1 or 2 wherein the line on which said floats are uniformly spaced is so located below the top edge that approximately 40% of the distance from the top to bottom edges is above the water surface when the boom is in the water.

11. The boom of either of claims 1 or 2 wherein said reinforcing fibers are secured to said panel by a heat-cured urethane matrix, said urethane matrix being continuous and keeping separate and substantially parallel the individual fibers of said belt.

12. The boom of claim 3 wherein said adhesive securing said floats, battens, batten covers and reinforcing belt is a heat-sensitive polyether-based urethane.

13. The boom of either of claims 1 or 2 wherein said weights are metal rivets having male and female members on opposite sides of said panel secured together through said panel.

14. The boom of claim 13 wherein said weights are lead.

15. The boom of claim 13 wherein said weights are calcium-lead alloy.

16. The boom of either of claims 1 or 2 wherein said attachment means is a vertical rod secured to each end of said panel.

17. The boom of claim 16 wherein said rod is nylon.

18. The boom of claim 2 wherein said handles are molded polyether-based urethane.

19. A method for assembling a fence-type containment boom for containing water-borne pollutants, comprising:

(a) laying out a continuous, seamless panel having top and bottom edges and two opposed ends such that the warp fibers are continuous between the ends;

(b) coating both sides of a plurality of stiffening battens with a heat-sensitive adhesive and placing them in a uniform arrangement normal to and spaced along the longitudinal axis of the panel on one side of the panel;

(c) applying additional adhesive on the one side of the panel around the perimeter of each batten, placing a fabric batten cover over each batten, and heat curing the adhesive for securing said battens and batten covers to said panel;

(d) adhesively securing a plurality of floats to each side of said panel, said floats being uniformly spaced on a line substantially parallel to the longitudinal axis of said panel;

(e) immersing a plurality of continuous, elongated, high modulus, aramid fibers in a heat-sensitive adhesive, arranging the adhesive-coated fibers in closely-spaced, substantially parallel relationship on one side of said panel proximate the bottom edge substantially parallel to the longitudinal axis of said panel, placing the fibers in tension, and applying uniform heat simultaneously to the entire length of fibers and adhesive to cure the adhesive and secure the fibers to the panel;

(f) covering both sides of the panel, the floats, battens and batten covers, and tension fibers with a smooth, continuous coating of polyether urethane by an airless, solventless spray; and (g) attaching a plurality of ballast weight rivets uniformly spaced along a line proximate the bottom edge substantially parallel to the longitudinal axis of said panel, the male and female parts of said rivets being on opposite sides of said panel.

20. The method of claim 19 also including the steps of marking a plurality of openings spaced on a line proximate the top edge and substantially parallel to the longitudinal axis of said panel, placing holes through said panel proximate the perimeter of said marked openings for passage of elastomer, molding an elastomer handle around each marked opening on both sides of the panel and over the top edge thereof, and cutting three sides of said marked opening to provide a flap attached to said panel proximate the top edge for closing openings surrounded by said handles.

* * * * *